United States Patent [19]

Walker

[11] Patent Number: 4,689,592

[45] Date of Patent: Aug. 25, 1987

[54] COMBINED TRANSFORMER AND INDUCTOR

[75] Inventor: Charles S. Walker, Seattle, Wash.

[73] Assignee: Honeywell Inc., Minneapolis, Minn.

[21] Appl. No.: 722,751

[22] Filed: Apr. 12, 1985

Related U.S. Application Data

[63] Continuation of Ser. No. 422,331, Sep. 23, 1982, abandoned.

[51] Int. Cl.[4] ..... H01F 17/06; H01F 27/26

[52] U.S. Cl. ..... 336/83; 336/165; 336/178; 336/212

[58] Field of Search ..... 336/83, 160, 165, 178, 336/212, 92, 65

[56] References Cited

U.S. PATENT DOCUMENTS

| | | | |
|---|---|---|---|
| 1,803,868 | 5/1931 | Porter | 336/83 |
| 2,494,579 | 1/1950 | Pimlott et al. | 336/83 |
| 2,560,926 | 7/1951 | Brownell | 336/83 X |
| 2,567,394 | 9/1951 | Nottman | 336/83 |
| 2,579,308 | 12/1951 | Dole | 336/83 |
| 2,628,342 | 2/1953 | Taylor | 336/83 X |
| 2,823,359 | 2/1958 | Wentworth | 336/65 X |
| 2,949,591 | 8/1960 | Craige | 336/92 |
| 3,162,829 | 12/1964 | Wildy et al. | 336/83 |
| 3,209,294 | 9/1965 | Cornell | 336/83 X |
| 3,673,491 | 6/1972 | Baycura | 323/48 |
| 4,199,744 | 4/1980 | Aldridge et al. | 336/178 |
| 4,206,434 | 6/1980 | Hase | 336/165 X |

FOREIGN PATENT DOCUMENTS

| | | | |
|---|---|---|---|
| 213236 | 6/1956 | Australia | 336/83 |
| 33021 | 10/1956 | Fed. Rep. of Germany | 336/83 |
| 951826 | 11/1956 | Fed. Rep. of Germany . | |
| 1439441 | 12/1968 | Fed. Rep. of Germany . | |
| 797868 | 5/1936 | France . | |
| 995846 | 12/1951 | France . | |
| 1364128 | 5/1964 | France | 336/83 |
| 710719 | 6/1954 | United Kingdom | 336/83 |
| 957152 | 5/1964 | United Kingdom . | |

*Primary Examiner*—Thomas J. Kozma

*Attorney, Agent, or Firm*—Roger W. Jensen

[57] ABSTRACT

A single electromagnetic structure comprising a pair of assembled oppositely positioned pot cores, first and second winding means around each of the pedestals of the cores, and a flat magnetically permeable washer-like member positioned between the windings and spaced from the pedestals and the outer annular rim portions of the pot cores to define a pair of air gaps, whereby the apparatus functions like a transformer and an inductor in series with a winding of the transformer.

1 Claim, 10 Drawing Figures

COMBINED TRANSFORMER AND INDUCTOR

The Government has rights in this invention pursuant to Contract No. N00024-79-C-6277 awarded by the Department of the Navy.

This application is a continuation, of application Ser. No. 422,331, now abandoned, filed Sept. 23, 1982.

This invention relates to the field of electrical engineering, and particularly to the design of transformers and inductance devices.

BACKGROUND OF THE INVENTION

An important goal in present day design of electrical equipment is reduction in size: even when actual miniaturization is not attempted, space and volume reduction is considered desirable. One way to accomplish such reduction is to combine functions in a single device structure.

There are numerous situations where the work of the designer of electrical equipment is very seriously compromised by space limitations, particularly in connection with high performance installations for use in aircraft, guided missiles, and the like. A great deal of equipment must be positioned in the nose of a submarine torpedo, for example, if all of the control, target seeking, and like functions required from a torpedo are to be successfully accomplished. The envelope of the torpedo defines the available space, and the design problem is to produce the necessary equipment in such dimensions as to fit into that space.

This is particularly important in connection with components which by the nature of their function relative to sonar transmission or reception, for example, must be physically located close to the torpedo envelope. An obvious design step is to select circuit components which are as space efficient as possible, but another useful step has been found, namely, that of combining the functions of two or more circuit elements within a single physical body, where this can be done without greatly increasing the size of the body itself. Successful use of expedients such as this may make all the difference between a practical, useable piece of equipment, and an arrangement which is otherwise desirable, but cannot be fitted into the space available.

BRIEF SUMMARY OF THE INVENTION

The present invention comprises an arrangement for combining in a single structure the functions of a transformer and one or more fixed inductors.

Various advantages and features of novelty which characterize the invention are pointed out with particularity in the claims annexed hereto and forming a part hereof. However, for a better understanding of the invention, its advantages and objects attained by its use, reference should be had to the drawing which forms a further part hereof, and to the accompanying descriptive matter, in which there are illustrated and described certain preferred embodiments of the invention.

BRIEF DESCRIPTION OF THE DRAWING

In the drawing, in which like reference numerals identify corresponding elements throughout the several views.

DESCRIPTION OF THE PREFERRED EMBODIMENT

The invention comprises modification of a "pot core" transformer to add the function of one or more additional inductances without changing the characteristics of the device as a transformer.

Figure 1:
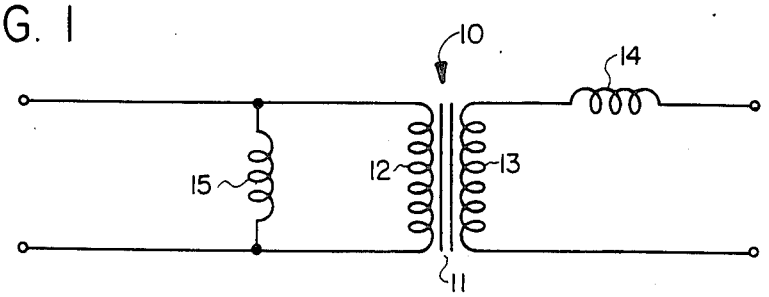
FIG. 1 is a wiring diagram illustrative of the invention showing an equivalent circuit.

FIG. 1 shows that one embodiment of the device may include a transformer 10, having a core 11, a primary winding 12, and a secondary winding 13, combined with a fixed inductance 14 in series with winding 13, and, if desired, a fixed inductance 15 in parallel with winding 12.

Figure 2:
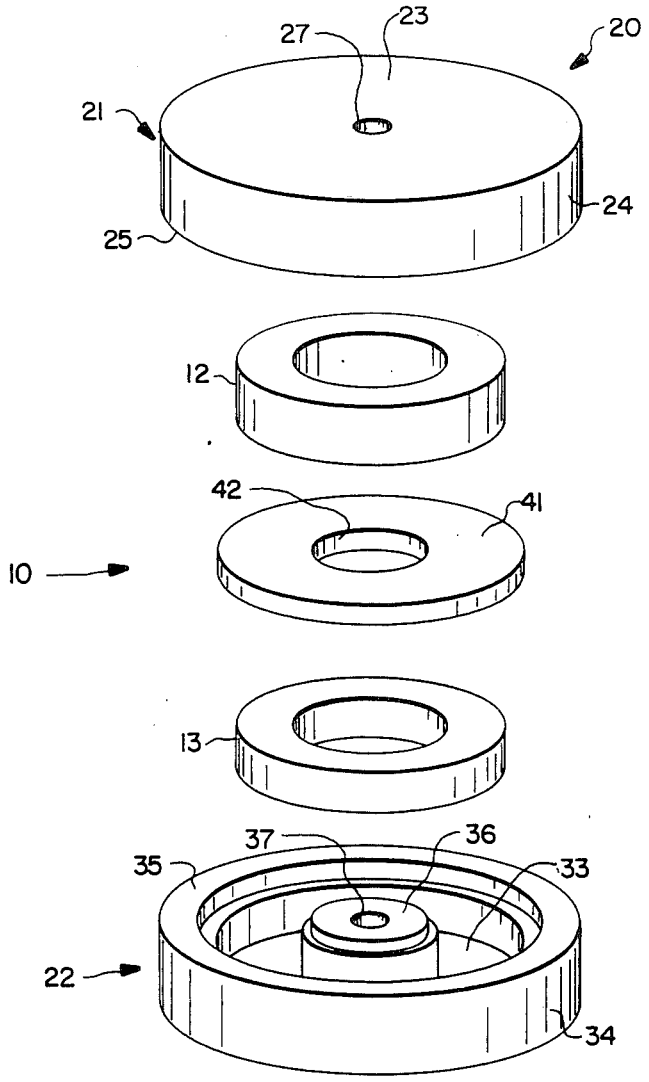
FIG. 2 is an exploded view of a device according to the invention shown schematically.
Figure 3:
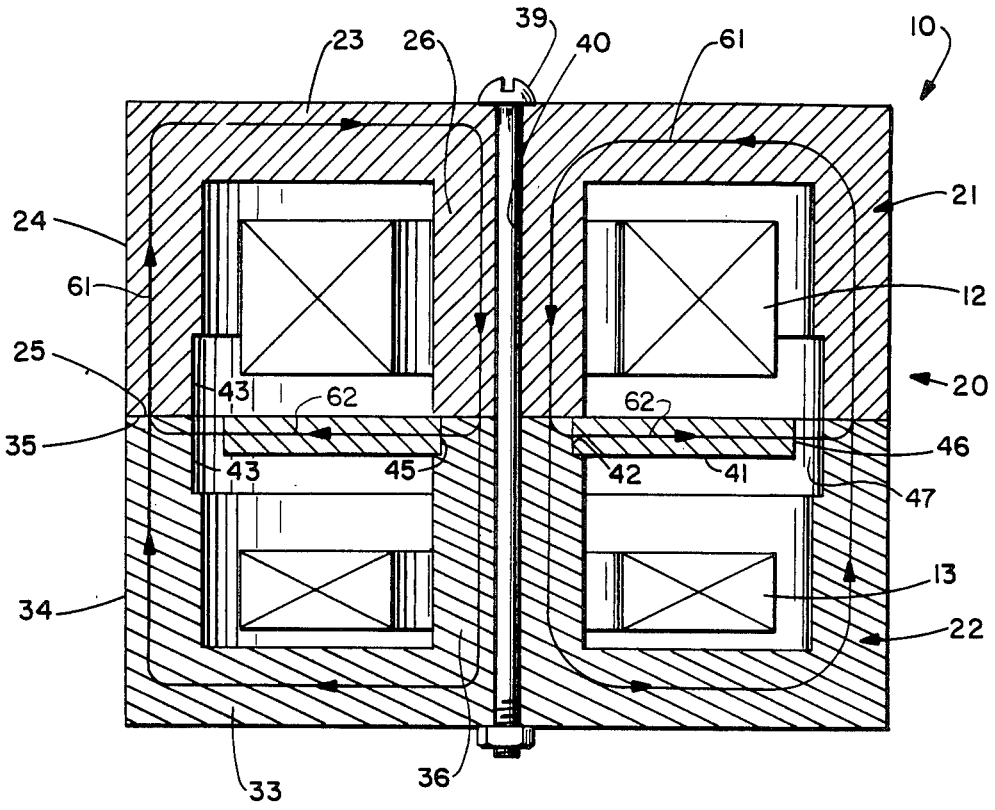
FIG. 3 is an axial sectional view of the device of FIG. 2 showing the washer and gap which produce an equivalent series inductance.

FIGS. 2 and 3 show the transformer 10 is of the "pot core" type. It comprises a bipartite housing 20 including hollow, coaxial, generally cylindrical sections 21 and 22, of ferrite or other material of high magnetic permeability, which contain windings 12 and 13 respectively.

Housing 21 comprises an end wall or base 23 from which a peripheral wall 24 extends to a rim 25, and from which a central pedestal 26 extends in the same direction; pedestal 26 is traversed by an axial hole 27. Housing section 22 comprises an end wall or base 33 from which a peripheral wall 34 extends to a rim 35, and from which a central pedestal 36 extends in the same direction. Pedestal 36 is traversed by an axial hole 37.

Winding 12 is mounted in housing section 21 around its pedestal 26, and winding 13 is similarly mounted in housing section 22 about its pedestal 36. A suitable fastener 39 such as a nylon screw 40 passes through holes 27 and 37 to hold the sections in assembled relation with the rims and pedestals of the sections in apposition and contact, as shown in FIG. 3.

A disc or washer 41 of ferrite or other suitable material is located in housing 20 between windings 12 and 13, to act as a magnetic shunt. For this purpose pedestal 36 may be provided with an accurately machined shoulder 42, and rims 25 and 35 may be machined to give cylindrical surfaces 43 accurately coaxial with shoulder 42. Disc 41 is circular in section with a circular central bore 45 to fit shoulder 42 with a minimum air gap, and with a periphery at 46 uniformly spaced from rims 43 by a predetermined radial air gap 47.

In the absence of disc 41 the flux generated by winding 12 is continuous in the high permeability material linking winding 13. The flux path is indicated by the arrows 61 in FIG. 3.

When disc 41 is present, additional flux paths for winding 12 exist, as shown by arrows 62; these paths are also in ferrite material except where they pass through air gap 47. This flux path does not link winding 13, and as a result has the same overall effect as would a series inductor 14 added, as shown in FIG. 1. To a first approximation the inductance of that inductor is directly proportional to the product of the thickness of the disc multiplied by the perimeter of periphery 46, and is inversely proportional to the radial dimension of the gap; strictly speaking, a minimum air gap between bore 45 and shoulder 42 is unavoidable, and modifies the relation slightly, as do other paths between the disc and other parts of housing sections 21 and 22.

Figure 4:
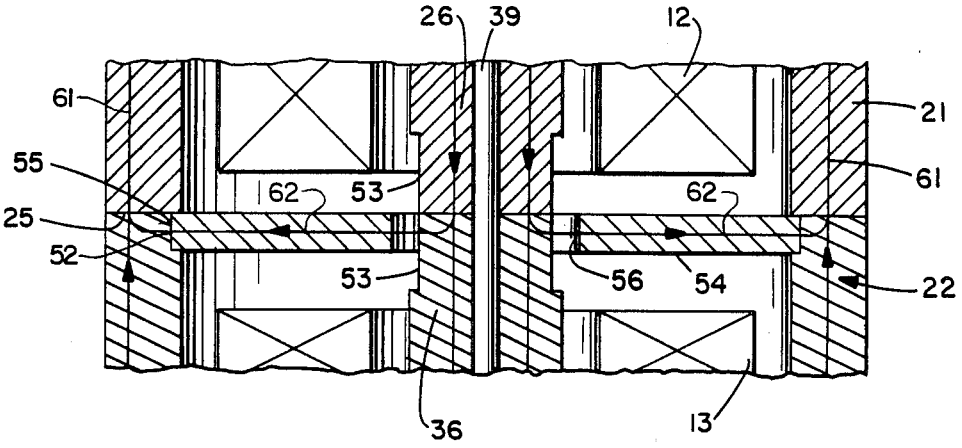
FIGS. 4 and 5 are fragmentary sectional views similar to FIG. 3, showing other embodiments of the invention.

In a modification of the invention shown in FIG. 4, a shoulder 52 is machined in rim 25 and pedestals 36 and 26 are machined to give cylindrical surfaces 53 accurately coaxial with shoulder 52.

A disc 54 of ferrite material has a periphery 55, to engage shoulder 52 with a minimum air gap, and a central bore 56 coaxial therewith to provide an air gap of predetermined width with the pedestal surfaces. The same principal and shunt flux paths are present in this structure.

Figure 5:
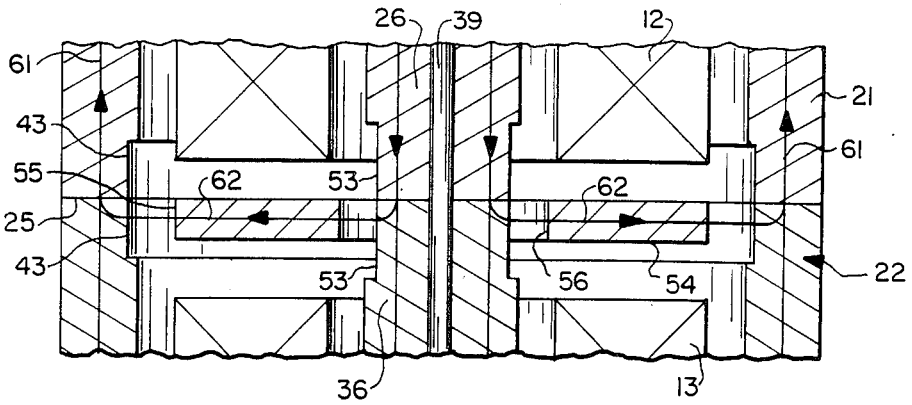

In a further modification of the invention shown in FIG. 5, the housing portions are machined to have the concave cylindrical surfaces 43 of FIG. 3 and the convex cylindrical surfaces 53 of FIG. 4, thus providing both inner and outer radial air gaps with respect to disc 54, which is conveniently mounted with respect to the housing sections by suitable means not shown.

Figure 6:
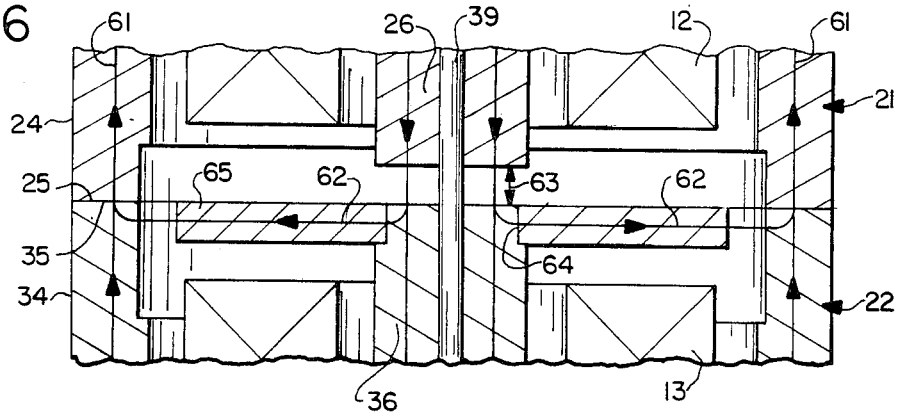
FIG. 6 is a fragmentary axial sectional view of a further embodiment of the invention showing the center post gap which produces the equivalent parallel inductor.

Reference should now be had to FIG. 6 which shows the structure of FIG. 3 with further modifications. Here, pedestal 26 is machined off so as not to contact pedestal 36, but to be spaced axially therefrom by an air gap 63, and has a shoulder 64 to receive a disc 65 of permeable material. The air gap 63 is in flux path 61, and functions as an inductor 15 (see FIG. 1) in parallel with the transformer winding.

Figure 7:
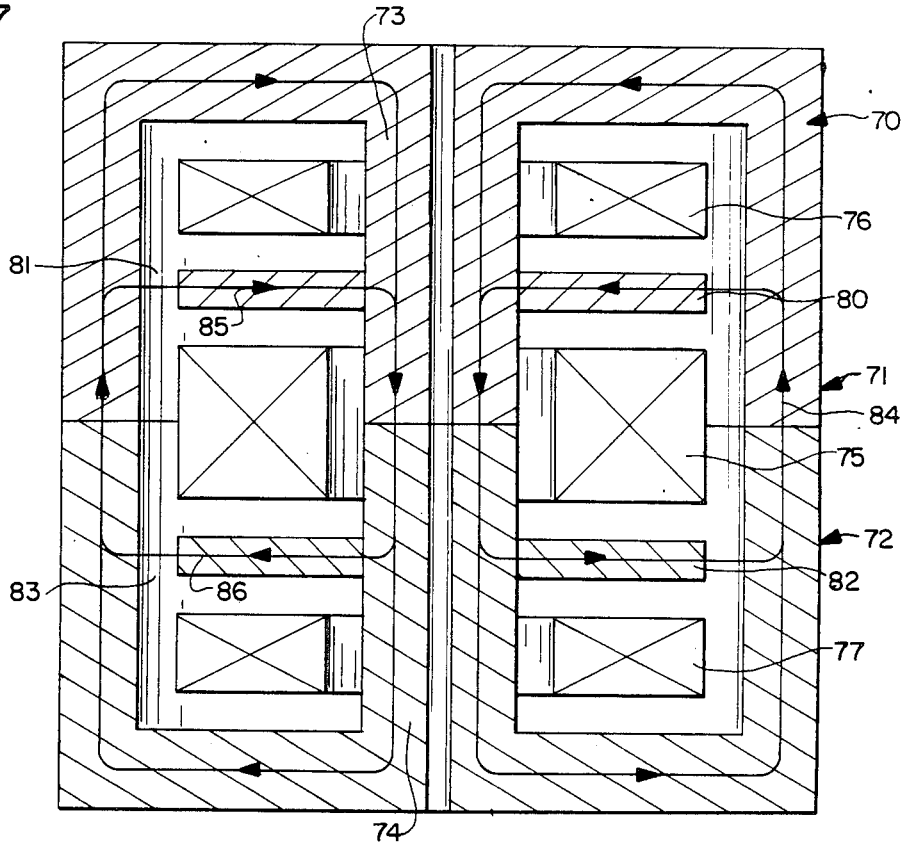
FIGS. 7 and 8 show the principal of the invention applies to a transformer having more than two windings.
Figure 8:
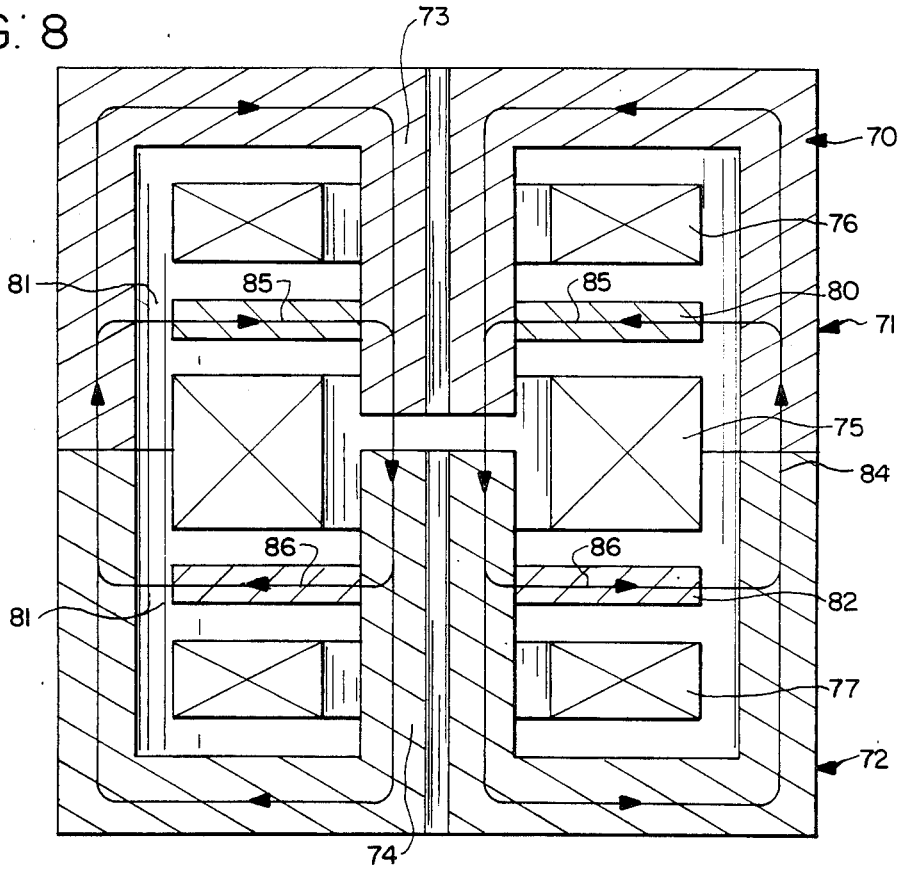

It occasionally happens that a series inductor is needed with a transformer having a plurality of secondary windings, which should have minimum interaction. FIGS. 7 and 8 show schematically how the desired result may be accomplished according to the present invention. Here, a housing 70 has sections 71 and 72 with central pedestal 73 and 74 on which are mounted a primary winding 75 and secondary windings 76 and 77. A ferrite disc 80 is mounted on pedestal 73 between windings 75 and 76, and has a radial outer air gap 81 with respect to housing section 71. A ferrite disc 82 is mounted on pedestal 74 between windings 75 and 77, and has a radial outer air gap 83 with respect to housing section 72.

The principal flux paths in this embodiment of the invention are suggested by the arrow 84 at the right of the figure, and links the primary winding 75. A secondary flux path is indicated by arrow 85 at the left of the figure, and links primary winding 75 but not secondary windings 76, while another secondary flux path is suggested by arrow 86 and links primary winding 75 but not secondary winding 77.

Figure 9:
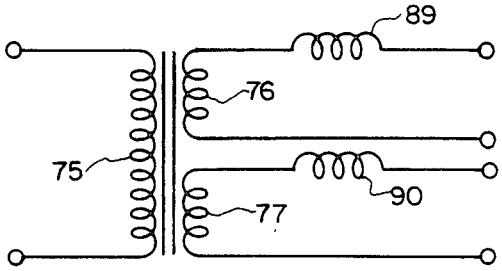
FIGS. 9 and 10 are circuit equivalents of the structures of FIGS. 7 and 8 respectively.

The circuit equivalent of the structure 89 is shown in FIG. 9, in which effective inductances 89 and 90 are shown in series with windings 76 and 77 respectively.

Figure 10:
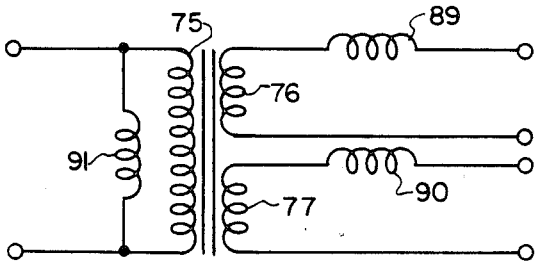

A further modification of the structure of FIG. 7 is shown in FIG. 8. Here, pedestal 73 and 74 are cut away so that they do not engage each other. The flux paths are as shown in FIG. 8, passing through the air gap between the pedestals. The circuit equivalent of the structure is shown in FIG. 10, where a further effective inductance 91 is shown in parallel with winding 75.

It is understood that the various standard techniques for forming the windings on suitable bobbins, with Faraday shields, if desired, mounting them in the housing sections, and again with Faraday shields, if desired, bringing out electrical connections, and varnish dipping or encapsulating may be applied to these structures.

While the insertion of ferrite discs may slightly increase one dimension of the unit, it avoids the need to provide and mount a separate inductance component.

From the above it will be evident that the invention comprises a means providing magnetic shunt paths in transformers to modify the leakage fluxes in such a fashion as to function as independent inductance units in series or in parallel with transformer windings.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

The embodiments of the invention in which an exclusive property or right is claimed are defined as follows:

1. Magnetic apparatus characterized by having (in a single, unitary coil and winding means structure) the electromagnetic equivalent of (i) an electrical transformer and (ii) an electrical inductor in series circuit relationship with a winding of said transformer, said magnetic apparatus comprising:

(a) a housing means of high magnetically permeable material having first and second pot cores, each of said pot cores having a circularly shaped base, a peripheral annular wall integral with said base and extending axially from said base to an annular rim surface, and a central pedestal integral with said base and extending axially from the center portion of said base to a pedestal end surface, said pot cores being assembled in abutting relationship with said ring surfaces and said pedestal end surfaces being respectively in direct contact, (b) a first winding means positioned between said pedestal and said annular wall of said first pot core so as to encircle the pedestal thereof, (c) a second winding means positioned between said pedestal and said annular wall of said second pot core so as to encircle the pedestal thereof, and (d) a flat washer-like member of high magnetically permeable material having an outer diameter selected to be less than the inner diameter of said annular walls adjacent to said abutting rim surfaces and a central circular aperture having a diameter selected to be greater than the diameter of said pedestals, said washer-like member being positioned between said windings and spaced from said walls and said pedestals, a pair of air gaps being thus defined between (i) said outer diameter of said washer-like member and said inner surface of said annular walls, and (ii) said central circular aperture of said washer-like member and said pedestals, whereby said apparatus functions upon one of said winding means being energized by alternating electric current as both (i) an electrical transformer having a pair of windings, and (ii) an inductor connected in series with one of said windings.

* * * * *